United States Patent [19]

Lin

[11] Patent Number: 4,909,349

[45] Date of Patent: Mar. 20, 1990

[54] EMERGENCY DESCENDING DEVICE

[76] Inventor: Shu-Huang Lin, No. 99, Lane 50, Hsin Ping Road, Taiping Hsiang, Taichung, Taiwan

[21] Appl. No.: 284,535

[22] Filed: Dec. 15, 1988

[51] Int. Cl.[4] ..... A62B 1/20

[52] U.S. Cl. ..... 182/5; 182/193; 188/65.4

[58] Field of Search ..... 182/5, 6, 7, 193; 188/65.5, 65.4

[56] References Cited

U.S. PATENT DOCUMENTS

| | | | |
|---|---|---|---|
| 465,464 | 12/1891 | Dixon | 182/5 |
| 1,195,069 | 8/1916 | Myers | 188/65.5 |
| 1,340,146 | 5/1920 | Blake | 188/65.5 |
| 1,836,462 | 12/1931 | Fowler | 182/5 |
| 3,317,971 | 5/1967 | Meyer | 182/5 |
| 4,506,760 | 3/1985 | Baker | 182/5 |

*Primary Examiner*—Reinaldo P. Machado

*Attorney, Agent, or Firm*—M. N. Meller

[57] ABSTRACT

This invention relates to an emergency descending device having a life line, one end of which is adapted to be fixed at a high position, the other end of which is adapted to be extended to a low position, and a descending apparatus movably affixed around the life line and usually kept at a high position before operation. The descending apparatus is adapted to suspend a person and carries the person along the life line at a low speed from a high position to a low position. The improvement is characterized by the descending apparatus comprising a decelerating element which is a tubular member axially passed by the life line, forming a contact surface within the tubular member, and in addition, the contact surface being corrugated so as to increase the friction between the contact surface and the life line and reduce the descending speed of the descending apparatus while it suspends a person and lowers him/her from the high position.

10 Claims, 3 Drawing Sheets

EMERGENCY DESCENDING DEVICE

BACKGROUND OF THE INVENTION

This invention relates to an emergency descending device, particularly to an emergency descending device having a pair of friction elements enveloped within a tubular housing, each friction element having a corrugated surface correspondingly engaged with that of the other, holding a life line therebetween, so as to carry a person along said life line at a low speed from a high position to a low position and provide a frictional force for controlling the rate of descent of a person.

In the past, various types of emergency descending devices have been proposed which can be used by a person in a high rise building to lower him/herself to the ground by paying out the line or cable from a reel.

Notwithstanding that many types of safety line reel-type emergency decending devices have been proposed, there has not really been any widely accepted use of such device. Part of the problem is that the earlier devices themselves are relatively expensive owing to complexity of structure and are not always foolproof in operation. For example, many such devices rely on a mechanical device to provide a retarding force or a frictional drag on the reel in order to slow the rate of descent of a person to a safe value. The existance of many mechanical elements in such a device for the purpose of providing a frictional force on the reel, complicate the entire structure of the emergency descending device. In addition, it is difficult to adjust such a mechanical device to provide the proper degree of friction. If there is too little friction, a person will drop too quickly risking bodily injury upon contact with the ground. If there is too much friction, the person cannot descend rapidly enough to escape from a dangerous situation.

SUMMARY OF THE INVENTION

It is therefore a main object of this invention to provide an emergency descending device which has a simple descending means to directly provide a frictional force on a life line thus simplifying the entire structure of said emergency descending device.

It is another object of this invention to provide an emergency descending device in which the rate of descent of a person can be easily controlled.

Accordingly, an emergency descending device according to this invention comprises a life line, one end of which is adapted to be fixed at a high position, the other end of which is adapted to be extended to a low position; and a descending means movably affixed around said life line and usually kept at said high position, said descending means being adapted to suspend a person, carrying said person along said life line at a low speed from said high position to said low position; wherein the improvement is characterized by said descending means comprising a decelerating means which is a tubular member axially passed by said life line, forming a contact surface within said tubular member, said contact surface being corrugated so as to increase the friction between said contact surface and said life line and reduce the descending speed of said descending means while it suspends a person and lowers him/her from said high position.

Moreover, said emergency descending device further comprises two controlling handles pivotally connected to said tubular means and abutting said tubular member, whereby a person descending from said high position may press said tubular member so as to provide an additional frictional force to control the rate of descent of the person by means of gripping said controlling handles.

BRIEF DESCRIPTION OF DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
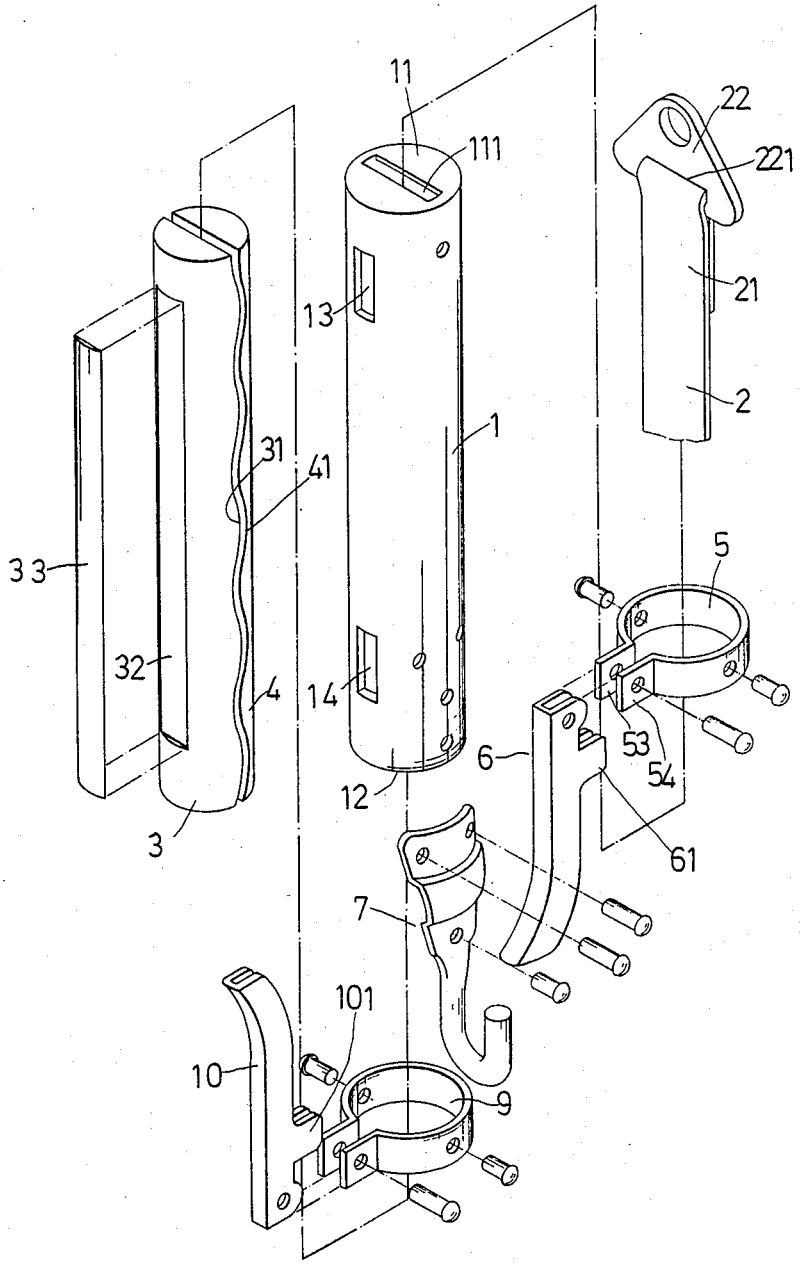
FIG. 1 is an exploded perspective view of a preferred embodiment of an emergency descending device according to this invention.
Figure 2:
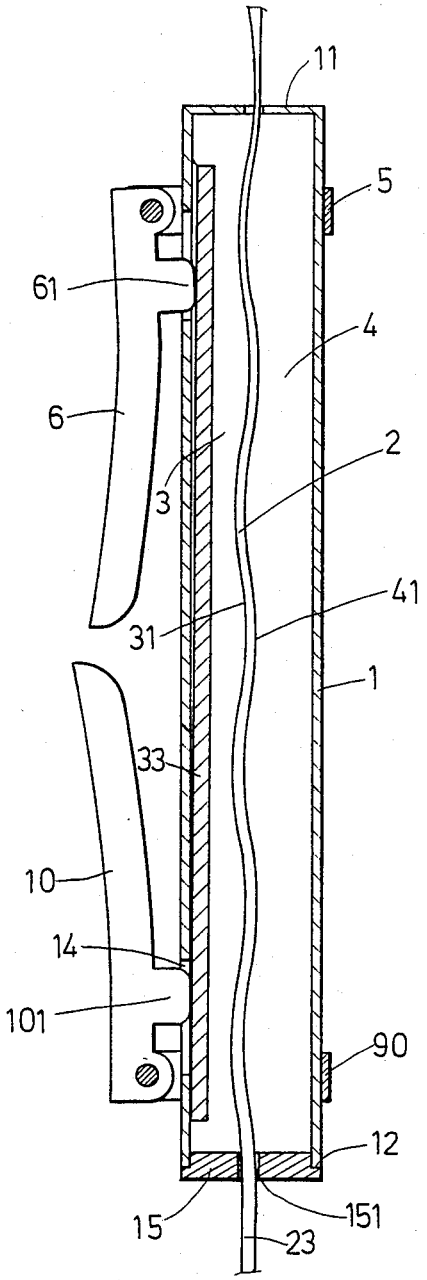
FIG. 2 is a sectional view of a preferred embodiment of an emergency descending device according to this invention.

Referring to FIGS. 1, 2, an emergency descending device according to this invention comprises a tubular housing 1 with a closed end 11 in which a slit 111 is formed and an opened end 12. Two rectangular holes 13, 14 are respectively formed near said closed end 11 and said opened end 12 of said tubular housing 1. A flat cable 2, which is nonflammable, has one end 21 engaged with a fastener 22 which has a slot 221 passed through by said end 21 of said plat cable 2. Said fastener 22 is generally attached to a fixed means, such as a door or a fence post located within the area from which a person is descending. The other end 23 of said flat cable 2 passes through said tubular housing 1 from said closed end 11 to said opened end 12 via said slit 111 and is adapted to extend to the position to where said person is descending. Said tubular housing 1 has a pair of friction elements 3, 4 enveloped within said tubular housing 1 which is generally made of rubber material. Said friction elements 3, 4 respectively have corrugated surfaces 31, 41 correspondingly engaged with each other and holding said flat cable 2 therebetween so as to increase the friction between the corrugated surfaces 31, 41 of said pair of friction elements 3, 4 and said flat cable 2. One of said friction element 3 has a groove 32 formed on the opposite side of said corrugated surface 31. A rigid body 33 is fitted into said groove 32 of said friction element 3. Two positioning rings 5, 9 are respectively riveted to said tubular housing 1 near said closed end 11 and said opened end 12 of the tubular housing 1. Each positioning ring has two protrusions, such as the protrusions 53, 54 of the positioning ring 5, outwardly and parallelly extended therefrom. Two controlling handles 6, 10 are respectively and pivotally connected to said protrusions of said positioning rings 5, 9 and have projected portions 61, 101 respectively extended therefrom, so that said projected portions 61, 101 of said controlling handles 6, 10 can abut against said rigid body 33 of said friction element 3 respectively via said two holes 13, 14 of said tubular housing 1. Whereby a person may grip said two controlling handles 6, 10 and enable said projected portions 61, 101 of said controlling handles 6, 10 to move inward and press said pair of friction elements 3, 4 so as to provide an additional friction force between said corrugated surfaces 31, 41 and said flat cable 2. In this respect, a person descending from a high rise building can control his/her descending rate not only by means of the inherent friction force between said corrugated surfaces 31, 41 of said pair of friction elements 3, 4 and said flat cable 2, but also by means of said additional friction which is applied by pressing said two controlling handles 6, 10. Moreover, said tubular housing 1 further has a hook member 7 riveted thereto near said opened end 12 of said tubular housing 1. In addition, a closure 15 with a guiding slit 151, which is adapted to be passed through by said flat cable 2, is fitted into said opened end 12 of said tubular housing 1, so that said pair of friction elements 3, 4 will not be pulled out from said tubular housing 1 when said flat cable is pulled from said closed end 11 toward said opened end 12 of said tubular housing 1, as shown in FIG. 2.

Figure 3:
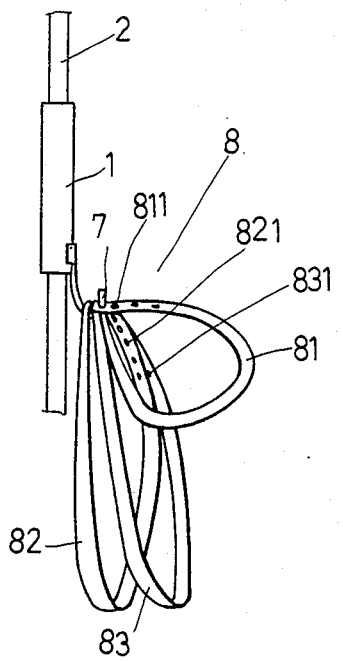
FIG. 3 is a perspective view of a supporting member of an emergency descending device according to this invention.

Referring to FIG. 3, a supporting member 8 connected with said hook member 7 of said tubular housing 1 is shown. Said supporting member 8 consists of three supporting belts 81, 82, 83. One end of each belt is fixedly connected to said hook member 8 and the other end of each belt has a plurality of length-adjustable punch holes 811, 821, 831 so that said other ends of said belts 81, 82, 83 can be grasped by said hook member 7 and each of said belts will form a loop. Said loops may be respectively passed through by the arms and thighs of a person and the length of said loops are adjustable by means of said length-adjustable punch holes 811, 821, 831 so as to support the person making the descent.

Figure 4:
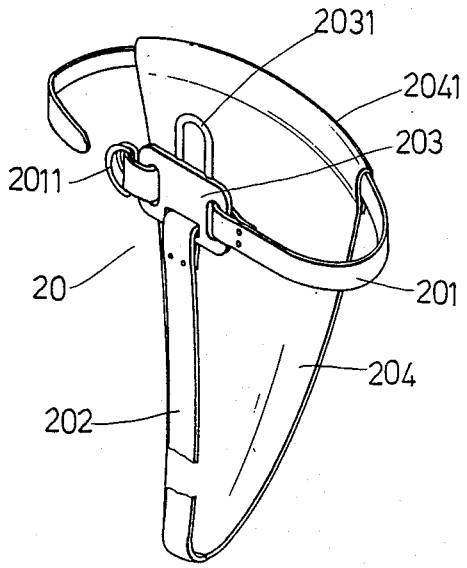
FIG. 4 is a perspective view of another type of supporting member of an emergency descending device according to this invention.

Referring to FIG. 4, another type of supporting member 20 is shown. Said supporting member 20 consists of two straps 201, 202, a connecting member 203 with a retaining ring 2031, and a piece of canvas 204. One strap 202 is connected between said connecting member 203 and said piece of canvas 204. The other strap 201 has one end fixedly connected to said connecting member and the other end adjustably connected to said connecting member 203 by two retaining rings 2041 of said connecting member 203, which is slidably received in the strap casing 2041 of said piece of canvas 204. Whereby said supporting member 20 can be retained on said hook member by means of said retaining ring of said connecting member and support a person by means of fastening said strap 201 around the waist of said person.

Therefore, a person descending from an elevated position supported by said supporting member 8 or 20 can reduce his/her descending rate by said friction between said corrugated surfaces 31, 41 of said friction elements 3, 4 and said flat cable 2 and can easily control his/her descending rate by means of the additional friction caused by gripping said controlling handles 6, 10 in a manner as described hereinbrfore. In addition, said flat cable 2 can be provided with a plurality of said emergency descending devices so as to be used by a predetermined number of persons descending along said flat cable 2 at one time thereby increasing the number of persons able to escape from the disaster. It can be found that said emergency descending device according to this invention has the advantage of simplicity of the structure and ease of operation.

With this invention thus explained, it is apparent that numerous modifications and variations can be made without departing from the scope and spirit of this invention. It is therefore intended that this invention be limited only as indicated in the appended claims.

I claim:

1. An emergency descending device comprising:

a life line, one end of which is adapted to be fixed at a high position, the other end of which is adapted to be extended to a low position;

a descending means movably affixed around said life line and usually kept at said high position, said descending means being adapted to suspend a person, carrying said person along said life line at a low speed from said high position to said low position; said descending means comprising a decelerating means which is a tubular member axially passed by said life line, forming a contact surface within said tubular member, said contact surface being corrugated so as to increase the friction between said contact surface and said life line and reduce the descending speed of said descending means while it suspends a person and lowers him/her from said high position, said decelerating means comprising a tubular housing which is passed by said life line; and a pair of friction elements enveloped within said tubular housing, each one of the friction elements having a corrugated surface correspondingly engaged with that of the other, holding said life line therebetween.

2. An emergency descending device as claimed in claim 1, wherein said life line is a flat cable so as to increase the friction between said contact surface and said life line.

3. An emergency descending device as claimed in claim 2, wherein said tubular housing has a closed end having a slit which is passed by said flat cable, and an opened end opposite said closed end.

4. An emergency descending device as claimed in claim 3, wherein one of said pair of friction elements has a groove formed on the surface thereof opposite said contact surface and a rigid body fitted into said groove.

5. An emergency descending device as claimed in claim 4, wherein said tubular housing has two positioning rings respectively connected around its two ends, each positioning ring having two protrusions outwardly and parallelly extended therefrom and a controlling handle pivotally connected to said protrusions, said controlling handle having a projected portion, and two holes respectively formed near said two ends of said tubular housing so that said projected portions of said controlling handles can abut against said rigid body of said friction element respectively via said two holes of said tubular housing, whereby a person may grip said two controlling handle and enable said projected potions of said controlling handles to move inward and press said pair of friction elements thereby providing an additional friction between said contact surface and said life line.

6. An emergency descending device as claimed in claim 5, wherein said tubular housing has a hook member fixedly connected thereto.

7. An emergency descending device as claimed in claim 6 further comprising a supporting member engaged with said hook member so as to support the person descending from a high position to a low position.

8. An emergency descending device as claimed in claim 7, wherein said supporting member consists of three supporting belt, one end of each belt being fixedly connected to said hook member and the other end of each belt having a plurality of length-adjustable punch holes so that said other ends of said belts can be grasped by said hook member and each of said belts will form a loop.

9. An emergency descending device as claimed in claim 8, wherein said supporting member consists of two straps, a connecting member with a retaining ring, and a piece of canvas, one of said straps being connected between said connecting member and said piece of canvas, the other strap having one end fixedly connected to said connecting member and the other end adjustably connected to said connecting member, which is slidably received in the strap casing of said piece of canvas, whereby said supporting member can be retained on said hook member by means of said retaining ring of said connecting member.

10. An emergency descending device as claimed in claim 9, wherein said tubular housing further comprises a closure in which a guiding slit is formed that is fitted into the opened end of said tubular housing, so that said flat cable can pass through said closure via said guiding slit and said pair of friction elements will not be pulled out from said tubular housing when said flat cable is pulled from said closed end toward said opened end of said tubular housing.

* * * * *